US005915821A

United States Patent [19]

Okajima et al.

[11] Patent Number: 5,915,821

[45] Date of Patent: Jun. 29, 1999

[54] SNOWBOARD BOOT

[75] Inventors: Shinpei Okajima, Izumi; Kazuki Tanaka, Sakai, both of Japan

[73] Assignee: Shimano, Inc., Osaka, Japan

[21] Appl. No.: 08/736,233

[22] Filed: Oct. 23, 1996

[30] Foreign Application Priority Data

Nov. 10, 1995 [JP] Japan ..... 7-317169
Jan. 26, 1996 [JP] Japan ..... 8-032796

[51] Int. Cl.[6] ..... A43B 5/04

[52] U.S. Cl. ..... 36/117.1; 36/118.2; 36/118.7; 36/118.8; 36/118.9

[58] Field of Search ..... 36/117.1, 118.2, 36/118.7, 118.8, 118.9

[56] References Cited

U.S. PATENT DOCUMENTS

| | | | |
|---|---|---|---|
| 3,732,635 | 5/1973 | Marker | 36/117.1 |
| 4,334,368 | 6/1982 | Chalmers, II et al. | 36/118.7 |
| 4,916,835 | 4/1990 | Begey et al. | 36/118.7 |
| 5,265,352 | 11/1993 | Chemello | 36/118.7 |
| 5,363,572 | 11/1994 | Marega et al. | 36/118.2 |
| 5,401,041 | 3/1995 | Jespersen | 280/14.2 |
| 5,435,080 | 7/1995 | Meiselman | 36/117 |
| 5,437,466 | 8/1995 | Meibock et al. | 36/115 |
| 5,499,461 | 3/1996 | Danezin et al. | 36/117.1 |

FOREIGN PATENT DOCUMENTS

| | | | |
|---|---|---|---|
| 174000 | 3/1986 | European Pat. Off. | 36/118.7 |
| 406212 | 1/1991 | European Pat. Off. | 36/118.7 |
| 2647649 | 10/1990 | France | 36/118.7 |
| 2719197 | 11/1995 | France | A43B 5/04 |
| 2807371 | 8/1979 | Germany | 36/118.8 |
| 3135170 | 4/1982 | Germany | 36/118.7 |
| 322746 A1 | 1/1988 | Germany | A63C 9/00 |
| 433503 C2 | 7/1995 | Germany | A43B 5/04 |
| M192A01237 | 5/1992 | Italy | 36/117.1 |

OTHER PUBLICATIONS

European Seaech Report for EP 96308086.6, dated Jan. 2, 1998.

*Primary Examiner*—Paul T. Sewell
*Assistant Examiner*—Anthony Stashick
*Attorney, Agent, or Firm*—James A. Deland

[57] ABSTRACT

A snowboard boot includes a toe portion, a heel portion and a leg portion. The heel portion and the leg portion are coupled so that the leg portion is capable of inclination in a longitudinal direction relative to the heel portion, and/or the heel portion and the leg portion are coupled so that the leg portion is capable of inclination in a lateral direction relative to the heel portion. In a more specific embodiment, a rigid heel overlap member is coupled to the heel portion, and a rigid leg overlap member is coupled to the leg portion. The heel overlap member and the leg overlap member overlap in a longitudinal direction. The heel overlap member and the leg overlap member are capable of relative movement in a vertical direction and/or rotation around a longitudinal axis. If desired, the heel overlap member and the leg overlap may interface through an arcuate or approximately spherical surface to facilitate relative movement in the desired directions. A position fixing means may be provided for fixing the vertical and/or rotational position of the leg overlap member relative to the heel overlap member.

13 Claims, 9 Drawing Sheets

SNOWBOARD BOOT

BACKGROUND OF THE INVENTION

The present invention is directed to snowboard boots and, more particularly, to a snowboard boot capable of selective longitudinal and/or lateral inclination.

A snowboard is a type of ski that is ridden sideways over snow. As with skis, special snowboard boots are used to bind the users feet to the snowboard.

The snowboarding World Cup is a competition based on points, and it is divided into Alpine competition (comprising slalom and downhill runs) and freestyle competition (comprising half-pipe and mogul runs). The boots used in Alpine competition are designed such that the attitude of the legs of the user are fixed with respect to the snowboard. However, ankle flexibility in both the longitudinal and lateral direction is required in the half-pipe competition. Thus, snowboard boots used in half-pipe competition must be such that the inclination attitude in the longitudinal and lateral directions may be adjusted and fixed. Clearly, snowboard boots used for Alpine competition do not have this capability, so there is a need for a snowboard boot that will accommodate both longitudinal and lateral inclination adjustability.

SUMMARY OF THE INVENTION

The present invention is directed to a snowboard boot with longitudinal and/or lateral adjustability, and wherein the longitudinal or lateral adjustment may be fixed.

In one embodiment of the present invention, a snowboard boot includes a toe portion, a heel portion and a leg portion. The heel portion and the leg portion are coupled so that the leg portion is capable of inclination in a longitudinal direction relative to the heel portion, and/or the heel portion and the leg portion are coupled so that the leg portion is capable of inclination in a lateral direction relative to the heel portion. In a more specific embodiment, a rigid heel overlap member is coupled to the heel portion, and a rigid leg overlap member is coupled to the leg portion. The heel overlap member and the leg overlap member overlap in a longitudinal direction. The heel overlap member and the leg overlap member are capable of relative movement in a vertical direction and/or rotation around a longitudinal axis. If desired, the heel overlap member and the leg overlap member may interface through an arcuate or approximately spherical surface to facilitate relative movement in the desired directions. A position fixing means may be provided for fixing the vertical and/or rotational position of the leg overlap member relative to the heel overlap member.

DETAILED DESCRIPTION OF THE EMBODIMENTS

Figure 1:
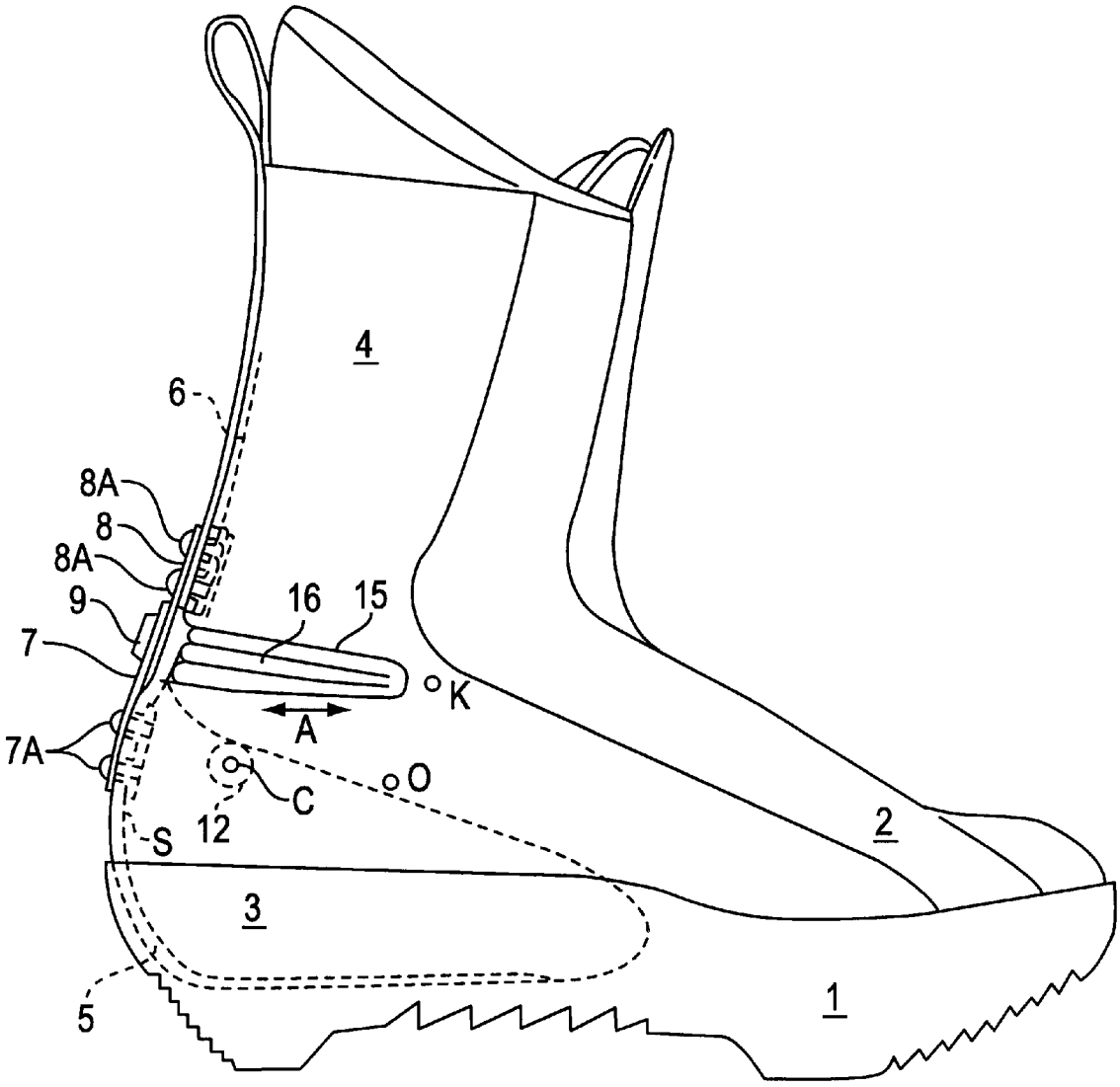
FIG. 1 is an elevational view of a particular embodiment of a snowboard boot according to the present invention.

FIG. 1 is an elevational view of a basic embodiment of a snowboard boot according to the present invention. All snowboard boots are made up of stiff portions and flexible portions, not necessarily integrated into a whole. For instance, the stiff portion and the flexible portion may be joined by an adhesive, stitching, eyelets, or another such means, or the stiff portion and the flexible portion may be overlapped in two or three plies, with the overlapping portions further displaced relative to each other. Thus, defining the boot base is difficult, but for snowboarding purposes, the portion that is fixed to the snowboard (the boot sole) can generally be defined as the boot base.

As shown in FIG. 1, a snowboard boot is made up of a sole component 1, a toe component 2, a heel component 3, and a leg component 4. The leg component is generally formed in a roughly cylindrical shape. The characteristic anklebone position in the present invention is indicated by point K. "Anklebone" refers to the protruding portion that projects from the left and right sides of the ankle. In this specification, this left and right direction is called the lateral direction. The lateral direction that passes through the anklebone is called the direction of the anklebone axis. The ankle rotates with this anklebone axis as its approximate center. The anklebone axis will hereinafter be referred to as the K axis. Of the rotation around this K axis, that is, the rotation of the leg component 4 with respect to the sole 1, the rotation in the direction in which the top of the leg component 4 goes toward the toe component 2 is called forward inclination. In contrast, the rotational movement of the leg component with respect to the boot sole around the lengthwise axis (the axis in the longitudinal direction that links the heel component and the toe component) in the horizontal direction perpendicular to the K axis is called swinging.

In this embodiment, the boot sole 1 is equipped with a liner (not shown) molded from a hard resin. The stiff heel portion 5 (called a heel cup) makes up a portion of the heel component 3, either integrally with or independently from the liner. Nylon 66 or another such material is used for the stiff heel portion 5. The stiff heel portion 5 shares the curved shape of the heel component 3. The stiff heel portion 5 can be molded as a riser portion that rises continuously to the portion extending over the boot sole 1, and it can also be provided independently of a so-called heel cup. The stiff heel portion 5 is molded such that it is exposed on the outside of the boot, but can also be molded such that it is on the inside and cannot be seen. A stiff leg portion 6 forms part of the leg component 4 at the top of the stiff heel portion 5, which is part of the heel cup.

A stiff heel overlap portion 7 is coupled to the stiff heel portion 5 via rivets 7*a*, and a stiff leg overlap portion 8 is coupled to the stiff leg portion 6 via rivets 8*a*. The stiff heel overlap portion 7 overlaps the stiff leg overlap portion 8 in the longitudinal direction. The stiff heel overlap portion 7 and the stiff leg overlap portion 8 are fixed such that they can move in the vertical direction relative to each other, and such that they can rotate relative to each other around the longitudinal direction a.

The stiff heel overlap portion 7 and the stiff leg overlap portion 8 are rotatably fixed by the pivot pin 9. The pivot pin 9 passes through a slot 11 (not shown; see FIG. 2 of Embodiment 2) made in the stiff heel overlap portion 7 and/or the stiff leg overlap portion 8. If the slot 11 is provided on the stiff heel overlap portion 7 side, for example, then a through hole (not shown) may be provided to the stiff leg overlap portion 8. In this embodiment, the contacting surfaces of the stiff heel overlap portion 7 and the stiff leg overlap portion 8 have a cross section (a vertical plane that passes through the center of the boot) in the form of circles, or an approximate circles, that center around the anklebone axis. Furthermore, the contacting surfaces may be part of spherical surfaces or approximately spherical surfaces. In either case, the approximate circles or approximately spherical surfaces share an approximate center with the K axis. Alternatively, the approximate circles or approximately spherical surfaces may have as their center a first imaginary center point O that is below the center of the K axis.

For the sake of the dynamic properties of the boot, the stiff heel portion 5 is designed such that its center of rotation is a second imaginary center point C that is set further back than the first imaginary center point O. The second imaginary center point C is sometimes provided with a pivot eyelet 12 that serves as a hinge to join the heel cup and the independently provided stiff heel portion 5. The cover portion above the horizontal plane that passes through the K axis is formed by a band-form portion 15 of a flexible material that wraps around the back of the heel. A cut-out 16 is formed over the center line of the bandform portion 15.

Figure 2:
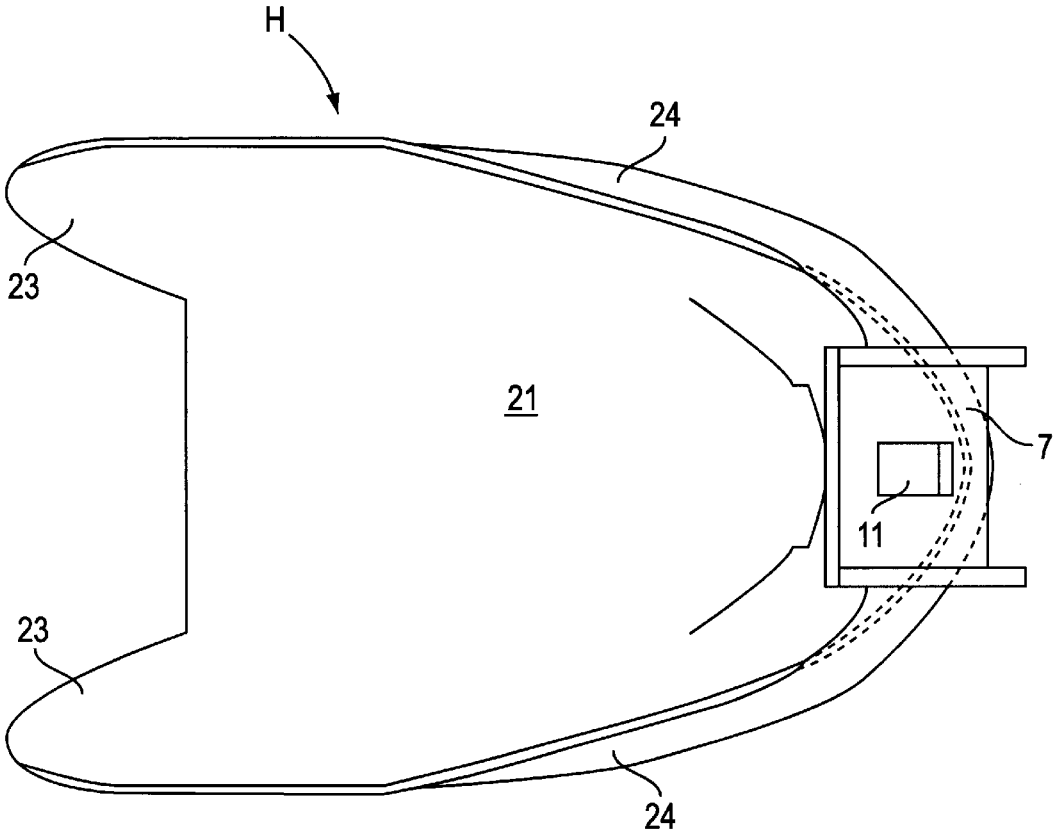
FIG. 2 is a top view of a particular embodiment of a heel cup according to the present invention.
Figure 3:
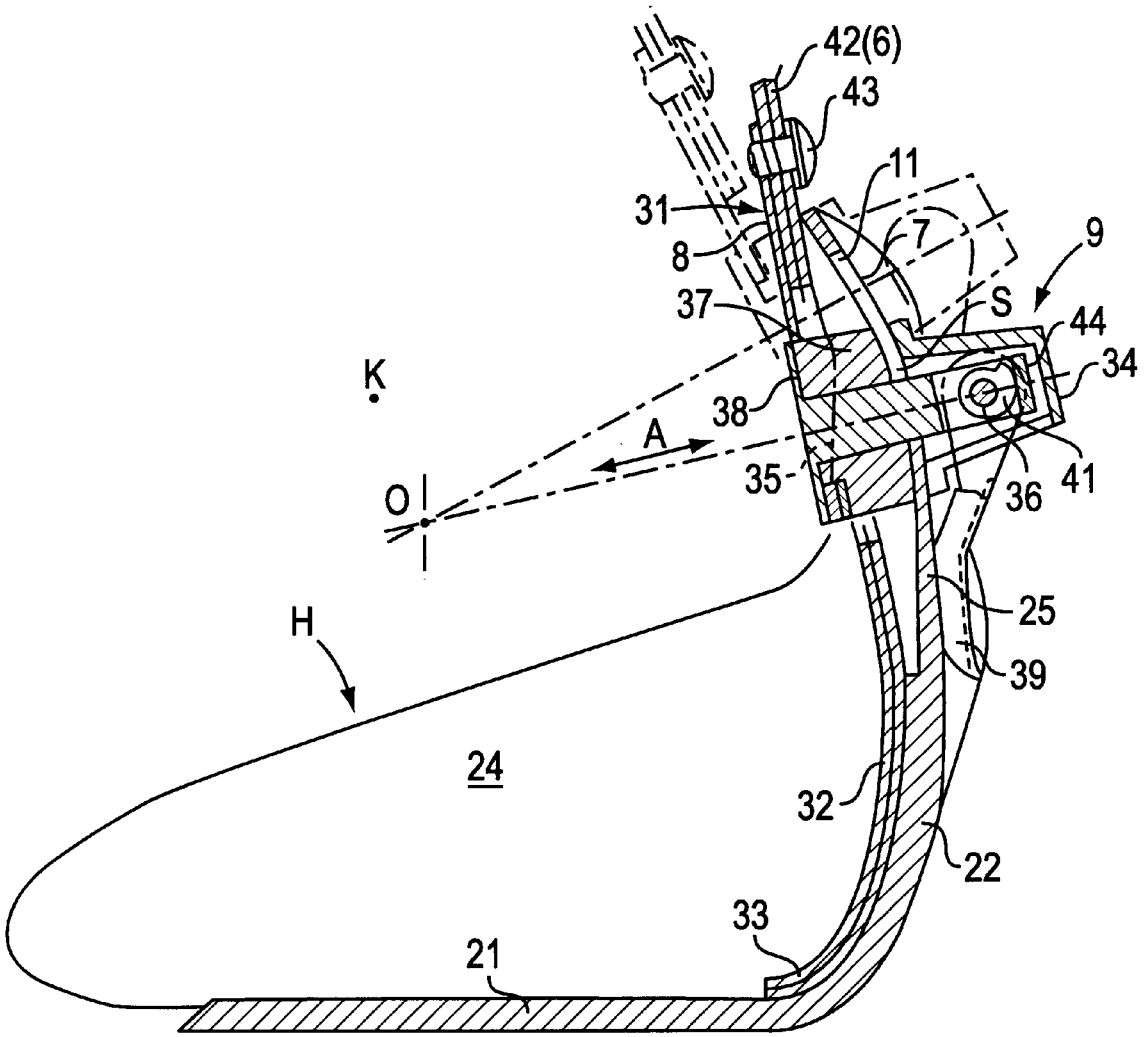
FIG. 3 is a cross sectional view of a portion of another embodiment of a snowboard boot according to the present invention.

FIG. 3 is a cross sectional view of a portion of another embodiment of a snowboard boot according to the present invention, and FIG. 2 is a top view of a heel cup used in this embodiment. The heel cup H shown in FIGS. 2 and 3 is slightly different from a conventional heel cup. A conventional heel cup is formed from a heel cup bottom 21 and a heel cup heel component 22. In this embodiment, however, the heel cup H comprises a heel cup bottom 21, a heel cup heel component 22, a heel cup bottom extension 23 that extends forward at the left and right positions from the heel cup bottom 21, and a heel cup side component 24 that extends forward at the left and right positions from the heel cup heel component 22 and curves slightly as it continues to the heel cup bottom 21. The heel cup heel component 22 is equipped with a heel cup vertical extension 25. The vertical extension 25 is an extension portion that extends a conventional heel cup upward. The vertical extension 25 is molded from a hard resin such as nylon 66, and is integral with the heel cup heel component 22. Thus, the vertical extension 25 corresponds to the stiff heel portion 5 shown in FIG. 1. The heel cup bottom 21 is formed relatively thick, and the heel cup vertical extension 25 is formed relatively thin.

A second heel cup 31 is provided independently of the heel cup heel component 22. Second heel cup 31 comprises an upper component 42, a curved component 32 which conforms to the inner surface of the heel cup heel component 22, and a bottom component 33. Upper component 42 functions as the stiff leg portion 6 in the first embodiment.

An upper portion of extension 25 forms a stiff heel overlap portion 7, and a stiff leg overlap portion 8 is coupled to the stiff leg portion 6 (upper component 42) via a rivet, screw, eyelet, or the like 43. The stiff heel overlap portion 7 overlaps the stiff leg overlap portion 8 in the longitudinal direction. The stiff heel overlap portion 7 and the stiff leg overlap portion 8 are fixed such that they can move in the vertical direction relative to each other, and such that they can rotate relative to each other around the longitudinal direction a.

The stiff leg overlap portion 8 and the stiff heel overlap portion 7 are fixed by a pivot pin assembly 9. The pivot pin assembly 9 comprises a handle shaft component 34 and a pin component 35 which, in this embodiment, passes through a vertically elongated slot 11 formed in the stiff heel overlap portion 7. A resin washer 37 is fitted within an opening 38 of the stiff leg overlap portion 8 and is interposed between the stiff leg overlap portion 8 and the stiff heel overlap portion 7. The inner edge of the washer 37 is formed into a flange, and pin component 35 passes through the opening in washer 37.

Handle shaft component 34 comprises a handle shaft 36 that is rotated by a handle 39. A cam 41 is attached to the handle shaft 36 such that bidirectional rotation of the cam 41 causes a cam follower 44 that is integrally molded with the pin component 35 to move pin component 35 bidirectionally in the direction a, thus fixing or unfixing the stiff leg portion overlap portion 8 and the stiff heel overlap portion 7 via washer 37.

The inner surface, and particularly the outer surface, of the stiff heel overlap portion 7 has a characteristic curved surface S. This curved surface S may be formed by an approximately cylindrical surface whose center axis line is the first imaginary center point O or the K axis. Alternatively, the curved surface S may be formed by an approximately spherical surface whose center is the first imaginary center point O or the K axis, or the like.

The operation of this embodiment now will be described. When the handle 39 is rotated counterclockwise, the stiff leg overlap portion 8, which was securely fastened via the washer 37, becomes free to be displaced in the vertical direction with respect to the stiff heel overlap portion 7. When the pivot pin assembly 9 thereafter is lifted up together with the handle 39, the pin component 35 is guided upwardly within the slot 11 in the stiff heel overlap portion 7. This movement causes part of the pivot pin assembly 9 to slide over the approximately cylindrical surface or approximately spherical surface S of the stiff heel overlap portion 7 to thereby move in an approximately circular fashion around the first imaginary center point O. This circular motion is easier if the first imaginary center point O is slightly lower than the K axis. Handle 39 is then rotated clockwise to fix stiff leg overlap portion 8 to stiff heel overlap portion 7 via washer 37.

The extent of the forward inclination of the stiff heel overlap portion 7 is slight, but the stiff leg overlap portion 8 is as a matter of course inclined further forward with respect to the stiff heel overlap portion 7 or the heel cup heel component 22. As a result, the leg component 4 is inclined forward with respect to the sole 1 or the heel cup bottom 21.

When the pivot pin assembly 9 is loosened, the stiff leg overlap portion 8 also can be rotated to the left and right with the pin component 35 as the rotational center axis. In other words, the leg component 4 is able to rotate with respect to the heel component 3. If the stiff heel overlap portion 7 and the rotationally displaced stiff leg overlap portion 8 are tightened and fixed by the pivot pin assembly 9, the attitude of the swing position will be securely maintained.

Figure 5:
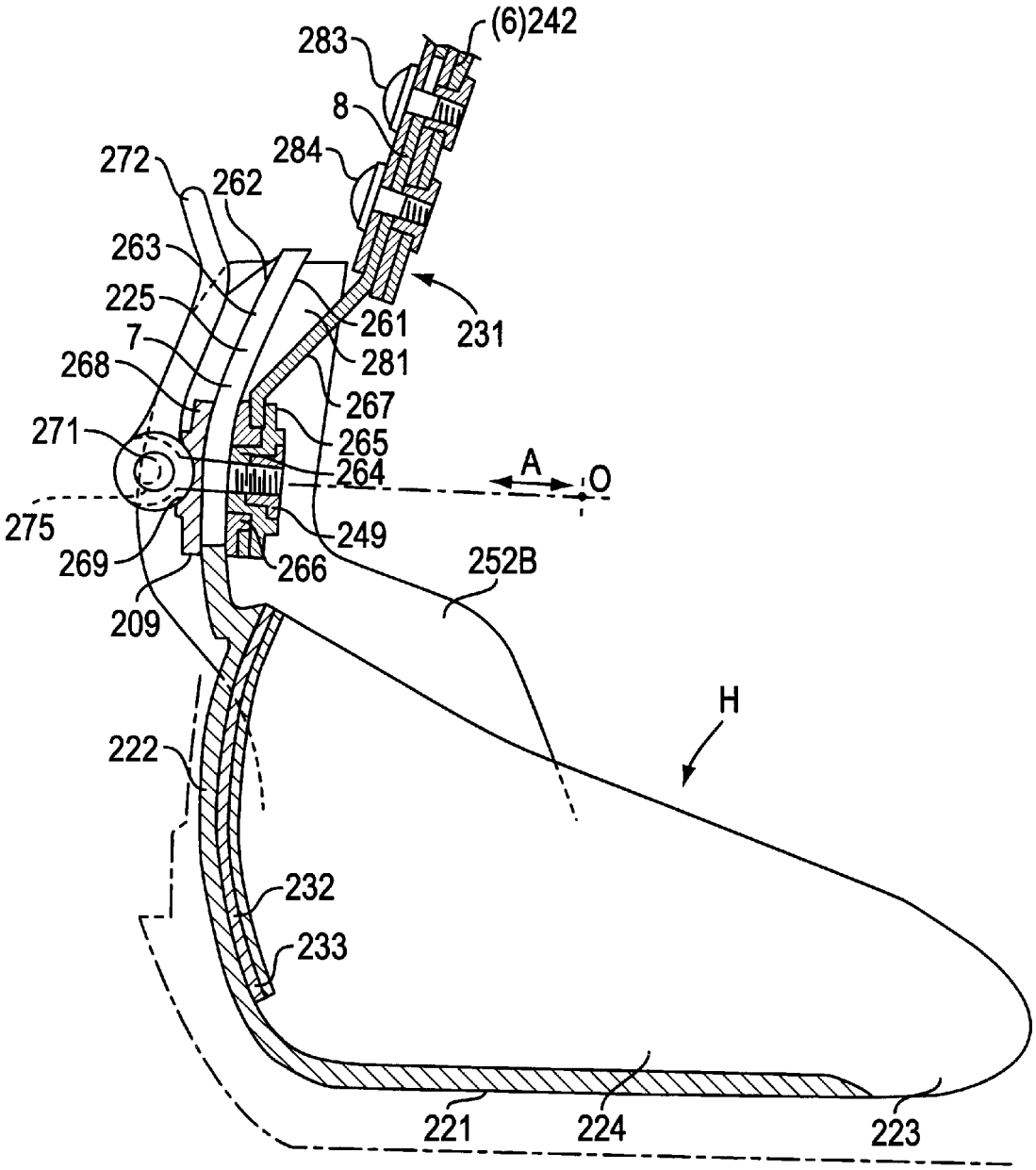
FIG. 5 is a cross sectional view of a portion of another embodiment of a snowboard boot according to the present invention.
Figure 6:
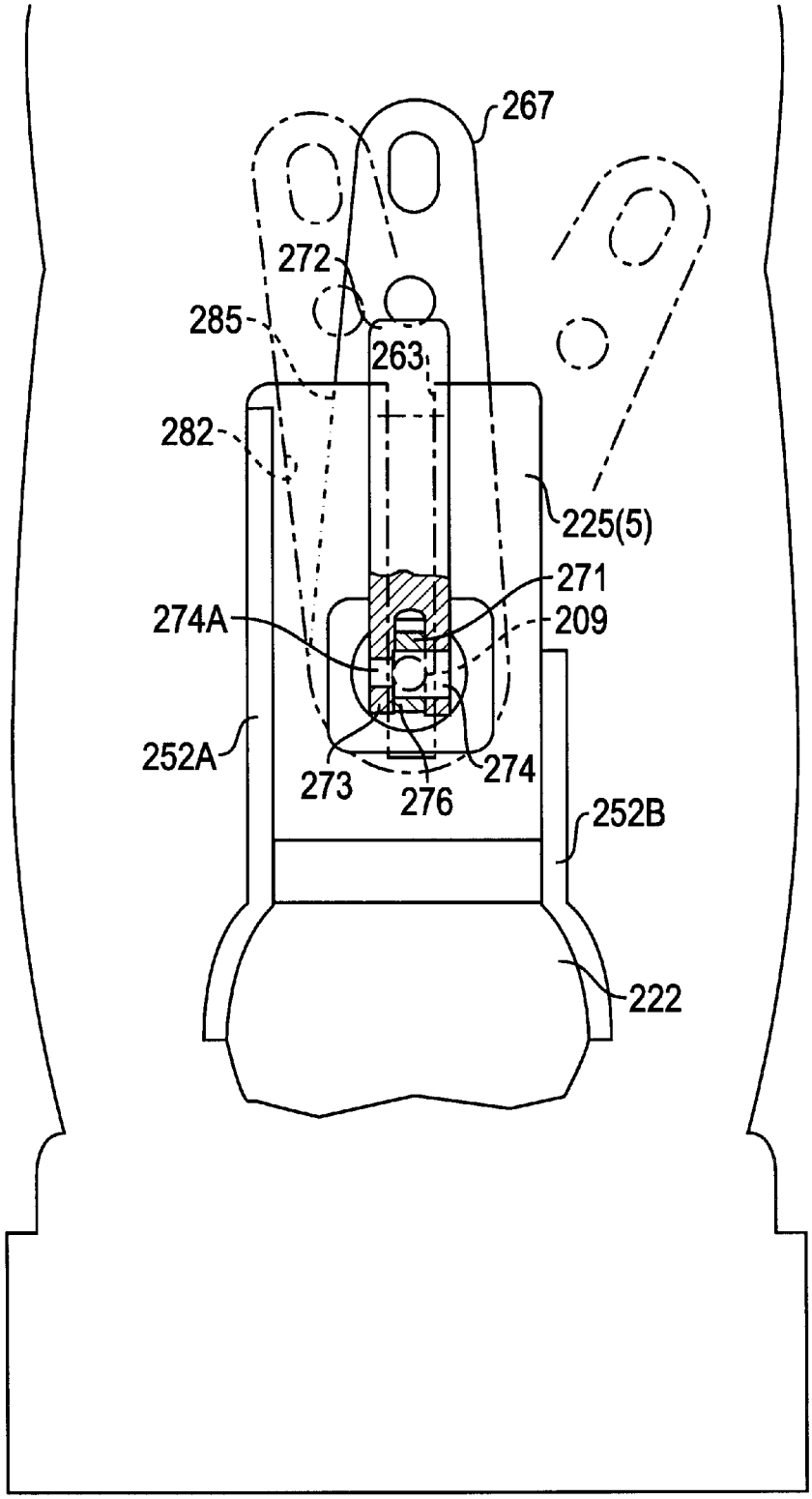
FIG. 6 is a rear view of the snowboard boot shown in FIG. 5.

FIG. 5 is a cross sectional view of a portion of another embodiment of a snowboard boot according to the present invention, and FIG. 6 is a rear view of the snowboard boot shown in FIG. 5. This embodiment differs from the embodiment shown in FIG. 3 in that the leg component is able to rotate or is able to incline in the lateral direction with respect to the heel component after the forward inclination of the leg component is fixed.

The heel cup H in this embodiment comprises a heel cup bottom 221, a heel cup heel component 222, a heel cup bottom extension 223 that extends forward at the left and right positions from the heel cup bottom 221, and a heel cup side component 224 that extends forward at the left and right positions from the heel cup heel component 222 and curves slightly as it continues to the heel cup bottom 221. The heel cup heel component 222 is equipped with a heel cup vertical extension 225, similar to extension 25 in FIG. 3, and the heel cup vertical extension 225 is formed thicker than the heel cup heel component 222. The heel cup vertical extension 225 is an extension portion that extends a conventional heel cup upward. The heel cup vertical extension 225 is molded from a hard resin such as nylon 66, and it is integral with the heel cup heel component 222.

A second heel cup 231 is provided independently of the heel cup heel component 222. Second heel cup 231 comprises an upper component 242, a curved component 232 which conforms to the inner surface of the heel cup heel component 222, and a bottom component 233. Upper component 242 functions as the stiff leg portion 6 in the first embodiment.

An upper portion of extension 225 forms a stiff heel overlap portion 7, and a stiff leg overlap portion 8 is coupled to the stiff leg portion 6 (upper component 242) via bolts 283 and 284. The stiff leg overlap portion 8 includes an inclination plate 267. The stiff heel overlap portion 7 overlaps the stiff leg overlap portion 8 in the longitudinal direction. The stiff heel overlap portion 7 and the stiff leg overlap portion 8 are fixed such that they can move in the vertical direction relative to each other, and such that they can rotate relative to each other around the longitudinal direction a.

The heel cup vertical extension 225 is formed by a cylindrical front surface 261 and a cylindrical rear surface 262 in which the front and rear surfaces (the right and left in FIG. 5) are both approximately cylindrical surfaces. A rotational center shaft 209 passes through an elongated vertical slit 263 disposed in the heel cup vertical extension 225. The rotational center shaft 209 faces approximately in the horizontal direction toward the imaginary center point O. The forward portion of the rotational center shaft 209 is threaded, and a nut 249 is fitted over these threads.

A rotational center bearing 264 is fitted around rotational center shaft 209 and slidingly contacts the cylindrical surface of the heel cup vertical extension 225. The rotational center bearing 264 is equipped with a flange 265 on the forward side. A rotating shaft 266 is fitted on the outer periphery of the rotational center bearing 264 between the rear surface of the flange 265 and the cylindrical front surface of the heel cup vertical extension 225. The rear surface of the rotating shaft 266 is formed in the shape of a cylindrical surface so that it can be swingably and rotatably joined to the cylindrical front surface 261 of the heel cup vertical extension 225. The rotating shaft 266 can rotate with the rotational center bearing 264 as its center axis. An inclination plate 267 is rotatably mounted on the rotating shaft 266 so that the inclination plate 267 is free to rotate around the rotational center shaft 209. The inclination plate 267 is part of the stiff leg overlap portion 8.

A seat 268 is disposed around rotational center shaft 209 and has a cylindrical front surface that slidingly contacts the cylindrical rear surface 262 of the heel cup vertical extension 225. The rear surface of the seat 268 is formed as a small cylinder bearing surface 269 which contacts a solid cylinder 271 which forms the rear of the rotational center shaft 209. As shown more clearly in FIG. 6, a lever 272 is equipped with a fork 273 that sandwiches the solid cylinder 271 on both sides.

A pin 274 having a large diameter eccentric component 275 in the shape of a solid cylinder is fixed to the fork 273. The large diameter eccentric component 275 is eccentric with respect to the axis of small diameter components 274A on both sides inside the fork. The large diameter eccentric component 275 is rotatably fitted into a hole 276 in the solid cylinder 271, wherein the diameter of the hole 276 is equal to the diameter of the large diameter eccentric component 275.

Riser plates 252A and 252B are joined to the curved surfaces on both sides of the heel cup heel component 222 and the heel cup side component 224. As shown in FIG. 6, the heel cup vertical extension 225 is integrally joined between the riser plates 252A and 252B on both sides for strengthening the structure of the riser plates 252A and 252B. The riser plate 252A on the left side (the outside of the left leg, or the side facing the left leg from the right leg) rises up higher than the riser plate 252B on the right side. Riser plate 252A further includes a forward-facing component 281 as shown in FIG. 5. The forward-facing component 281 has an inside surface that is roughly vertical.

The heel cup heel component 222, stiff leg portion 6, heel cup vertical extension 225, and so on shown in FIG. 5 are covered by a cover (not shown), but the lever 272 is exposed on the outside of the cover. The cover can be opened and closed by means of a fastener provided to the cover, which allows the lever 272 to be operated.

The operation of this embodiment will now be described. When the lever 272 is in the upright position, the large diameter eccentric component 275 of the pin 274 is in its retracted position. As a result, the hole 276 of the solid cylinder 271 also is in a retracted position, and the distance between the nut 249 that is threaded to the rotational center shaft 209 and the front surface 261 of the heel overlap portion 7 is shortened. As a result of this shortening, the center bearing 264 is secured to heel overlap portion 7 which, in turn, fixes the rotating shaft 266 vertically with respect to the heel cup vertical extension 225. That is, the rotating shaft 266 does not undergo any relative movement in the up and down direction with respect to the heel cup vertical extension 225. However, the inclination plate 267 is free to rotate with respect to the rotating shaft 266.

With a snowboard, the feet are placed generally perpendicular to the direction of advance of the board. Thus, when the snowboard travels over an undulating surface, the legs are subjected to periodic, back and forth lateral forces. Since the stiff leg portion 6 is rotatably supported by the rotating shaft 266 via the inclination plate 267, the stiff leg portion 6 can periodically swing back and forth around the rotational center shaft 209 to accommodate these lateral forces.

In this embodiment, the movement or inclination of the inclination plate 267 toward the outside (to the left in FIG. 6) is restricted by the inner surface 282 of the forward-facing component 281. On the other hand, the movement or inclination of the inclination plate 267 toward the inside (to the right in FIG. 6) is not restricted. The center line of the inclination or swing of the inclination plate 267 is the center line of the rotational center shaft 209, which faces the imaginary point O. Since the swing center line is positioned at roughly the same height as the anklebone, the swing of the leg component instantly corresponds to the inclination of the leg.

If the lever 272 is rotated and lowered together with the pin 274, the rotational center shaft 209 will move forward and the tightening force on center bearing 264 will be released. As a result, the rotational center bearing 264 can be moved up and down with respect to the heel cup vertical extension 225 to adjust the forward inclination of leg overlap portion 8. This up and down movement is accomplished when the various cylinder surfaces of the rotating shaft 266, the rotational center bearing 264, and the seat 268 slide along the front and rear cylinder surfaces of the heel cup vertical extension 225. In this embodiment, the center line of the rotational center shaft 209 roughly faces the imaginary center point O regardless of the height. In order to fix the rotational center bearing 264 at the desired height, the lever 272 is lifted up at this position.

When the rotational center shaft 209 is at a high position, the inclination angle with respect to the horizon is greater, and the stiff leg portion 6 inclines forward. Research conducted by the firm of the Applicant has revealed that with a snowboard, forward inclination of the legs when they are fixed into the snowboard boots makes the legs more powerful. The above-mentioned periodic swing and inclination motion in the lateral direction are possible at any forward inclination angle position. The swing movement of the legs in a suitable forward inclination angle attitude boosts the leg power and enhances skiing performance.

This embodiment would function the same as the embodiment shown in FIG. 3 if a structure is provided to tighten the inclination plate 267 between the flange 265 and the front surface 261 with the lever 272.

Figure 4:
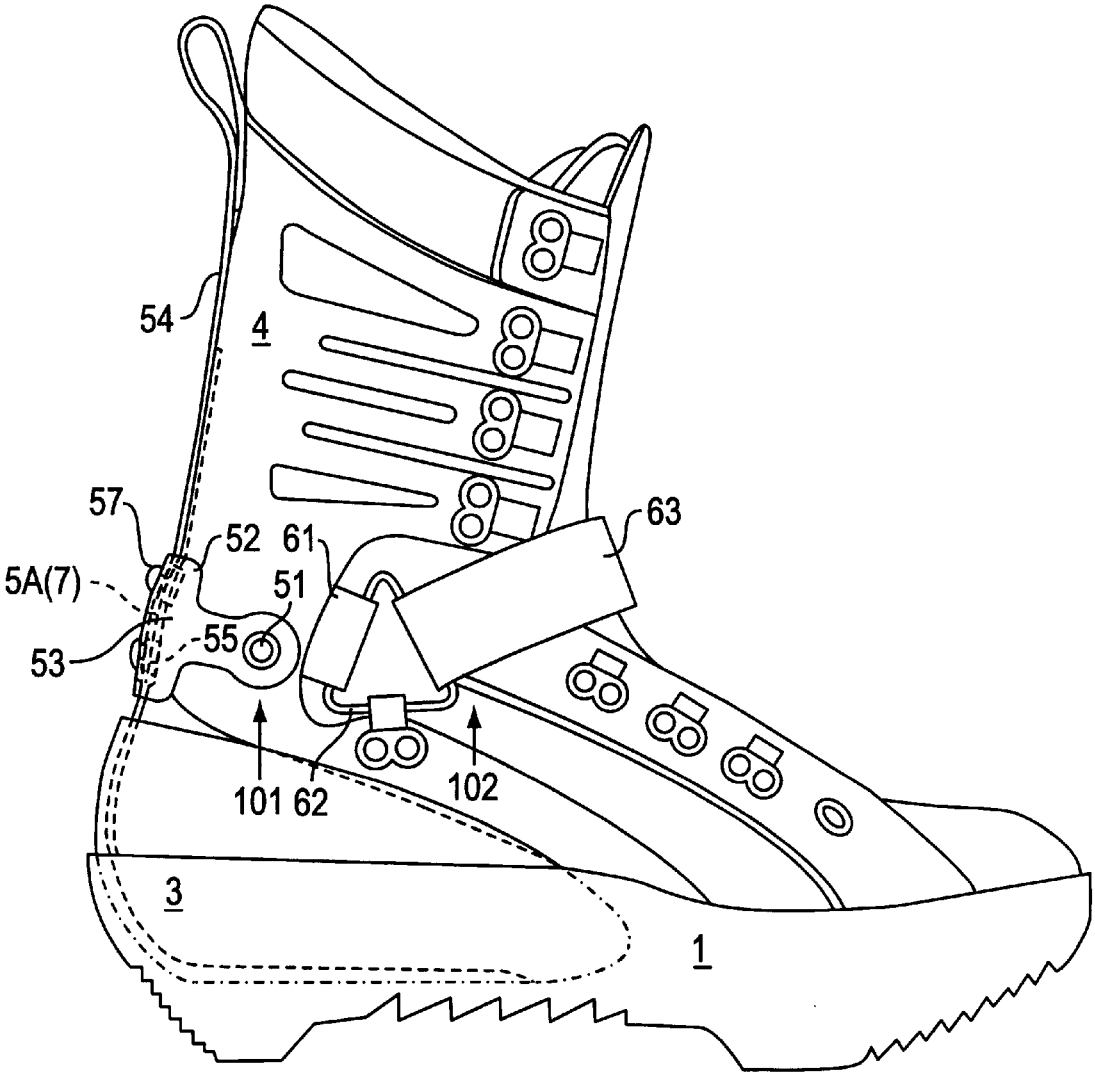
FIG. 4 is an elevational view of another embodiment of a snowboard boot according to the present invention.

FIG. 4 is an elevational view of another embodiment of a snowboard boot according to the present invention. The swing means in the lateral direction is not shown in the figure, but the swing means shown in any of the previous embodiments can be applied without modification to this embodiment. That is, the structure can be such that a stiff heel overlap portion and a stiff leg overlap portion, which overlap in the longitudinal direction, are allowed to swing by a pivot means that serves as a joining hinge (such as the pivot pin assembly 9 in the previous embodiments).

In this embodiment, the forward inclination means comprises a forward inclination means 101 and a forward inclination means 102. The forward inclination means 101 is equipped with two left and right rotation members 51 (only one of which is shown) fixed on both sides of the boundary between the heel component 3 and the leg component 4, and a band 52 that connects the two rotation members 51 and curves back around the rear surface of the heel component 3 via a curved portion 53. The curved portion 53 forms a second stiff heel portion 5*a* that is exposed on the outside. The curved portion 53 can be lifted upward with respect to the heel component 3 by a pull strap 54. The stiff leg portion 6 (not shown) is formed in the middle of the cover at the boundary portion between the heel component 3 and the leg component 4.

The second stiff heel portion 5*a* and the stiff leg portion 6 have the stiff heel overlap portion 7 and a stiff leg overlap portion 8 (not shown), respectively, that overlap in the longitudinal direction. The stiff heel overlap portion 7 and the stiff leg overlap portion 8 are fixed such that they are free to move relative to each other in the up and down direction. Part of the stiff leg overlap portion 8 goes through the cover, and the portion that is outside the cover passes through a second slot 55 of the stiff heel overlap portion 7 and contacts the outer surface of the stiff heel overlap portion 7. At this contacting location, the stiff heel overlap portion 7 is fixed with respect to the stiff leg overlap portion 8 by a nut 57.

If the stiff heel overlap portion 7 is lifted by the pull strap 54, the stiff heel overlap portion 7 will rotate and incline forward around the rotation members 51 as it moves upward with respect to the stiff leg overlap portion 8. When it is thus pushed by the forward-inclining stiff heel overlap portion 7, the leg component 4, including the stiff leg overlap portion 8, inclines forward.

The forward inclination means 102 comprises left and right stops 61 that are fixed by stitching to the heel component 3, left and right triangular rings 62 that are fitted into the stops 61, and left and right Velcro® straps 63 that are fixed to these rings. The Velcro® straps 63 form a fastener, so they overlap in a suitable length. The tension of the Velcro® straps 63 can be adjusted by a simple one-touch overlapping of the desired length.

The Velcro® straps 63 wrap around the boundary between the leg component 4 and the toe component 2, that is, the flexural center of the snowboard boot. When the Velcro® straps 63 are pulled tight, they cause the leg component 4 to incline forward with respect to the toe component 2. Since the forward inclination means 101 and the forward inclination means 102 impart a forward inclination force to the snowboard boot from the front and from behind, the forward inclination attitude is maintained stably.

Figure 7:
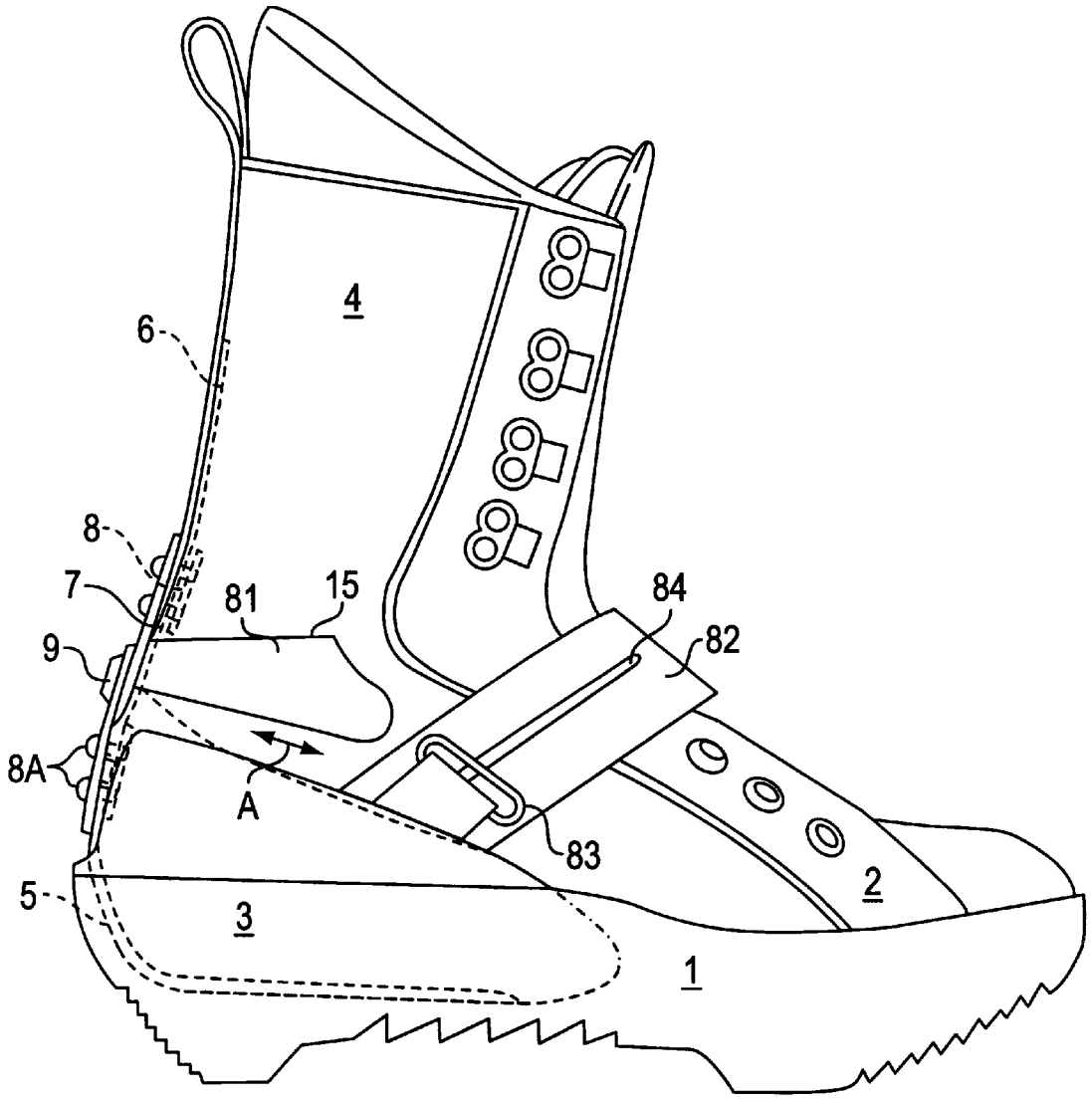
FIG. 7 is an elevational view of another embodiment of a snowboard boot according to the present invention.

Another embodiment of the snowboard boot shown in FIG. 7 is equipped with the longitudinal direction inclination fixing means and the lateral direction inclination fixing means of the embodiment shown in FIG. 1. However, in order to facilitate lateral direction inclination, the portion in the middle of the lateral direction inclination is formed from a flexible member 81. Furthermore, second Velcro® straps 82 that aid in forward inclination wrap around the boundary between the leg component 4 and the toe component 2, that is, around the flexural center of the snowboard boot. The second Velcro® straps 82 are fixed at their ends to stop rings 83. The second Velro® straps 82 are wide, and a cut-out portion 84 is provided along the center line thereof. This width and this cut-out portion 84 cause no pain to be felt in the instep of the foot even if the second Velcro® straps 82 are tightened very snugly. The core material of the second Velcro® straps 82 is in the form of a sponge.

Figure 8:
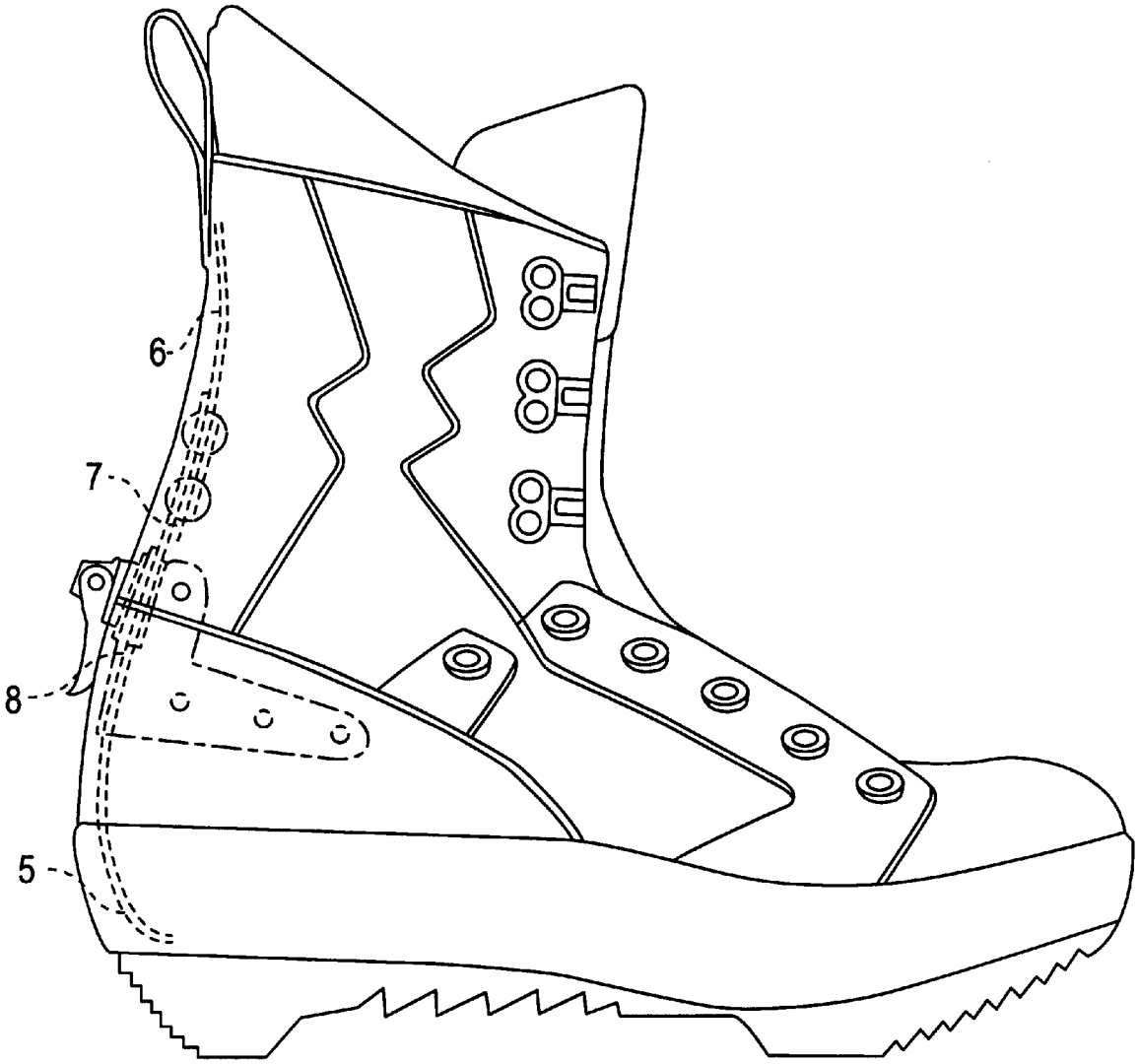
FIG. 8 is an elevational view of another embodiment of a snowboard boot according to the present invention.
Figure 9:
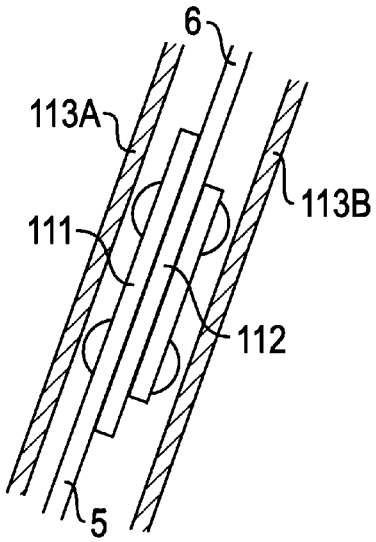
FIG. 9 is a cross sectional view of an alternative embodiment of a portion of the snowboard boot shown in FIG. 6.
Figure 10:
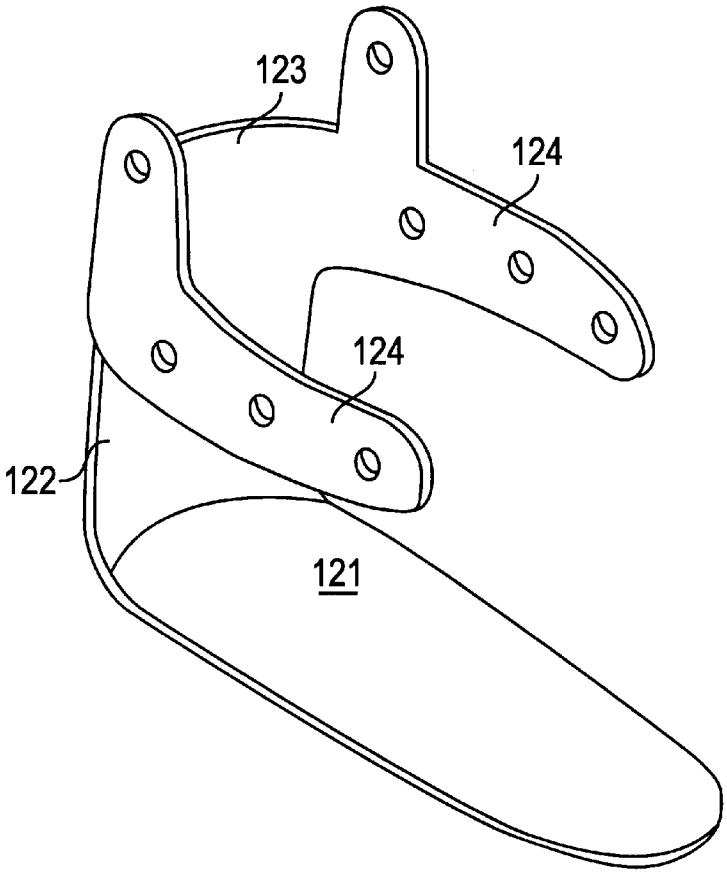
FIG. 10 is an oblique view of another embodiment of a heel cup used in a snowboard boot according to the present invention.

FIGS. 8–10 show another embodiment of a snowboard boot according to the present invention. In this embodiment, the stiff heel overlap portion 7 and the stiff leg overlap portion 8 can have the same overlapping relationship as in the previous embodiments. For example, the stiff heel overlap portion 7 and the stiff leg overlap portion 8 can be displaced in the vertical direction, and when fixed at the desired position in the vertical direction, are able to rotate at that position.

As shown in FIG. 9, overlapping portions 111 and 112 of the stiff heel portion 5 and the stiff leg portion 6 are housed inside two covers (inner and outer) 113*a* and 113*b*. Any overlapping portions can be so housed. Movement is possible in both the vertical direction and the lateral direction.

FIG. 10 shows another embodiment of the heel cup 5. In this embodiment, the heel cup has a heel cup bottom 121, a heel cup heel component 122, and a heel cup vertical extension 123. The heel cup side component 124 that extend forward from the heel cup heel component 122 at the left and right positions is highly independent from the heel cup bottom 121. Specifically, the heel cup side component 124 are connected to the heel cup bottom 121 via the heel component 122, but is not connected at the sides. With this embodiment, there is a high degree of freedom of the leg in the lateral direction with respect to the boot.

While the above is a description of various embodiments of the present invention, further modifications may be employed without departing from the spirit and scope of the present invention. For example, the heel cup 5 in FIG. 1 could include an integrally formed vertical extension like extension 25 shown in FIG. 3 rather than a separately attached heel overlap portion 7. The riser plates 252A and 252B in FIG. 6 could be made to restrict the range of lateral inclination in both directions rather than in one direction. Thus, the scope of the invention should not be limited by the specific structures disclosed. Instead, the true scope of the invention should be determined by the following claims. Of course, although labeling symbols are used in the claims in order to facilitate reference to the figures, the present invention is not intended to be limited to the constructions in the appended figures by such labeling.

What is claimed is:

1. A snowboard boot comprising:

a toe portion;

a heel portion having an external first heel side facing laterally, an external second heel side facing medially, and a rear heel side facing to the rear of the boot;

a leg portion having an external first leg side facing laterally, an external second leg side facing medially, and a rear leg side facing to the rear of the boot;

a rigid heel overlap member coupled to the heel portion at the rear heel side;

a rigid leg overlap member coupled to the leg portion at the rear leg side;

wherein the heel overlap member and the leg overlap member overlap in a longitudinal direction;

wherein the heel overlap member and the leg overlap member are capable of relative movement in a vertical direction;

wherein the heel overlap member and the leg overlap member are capable of relative rotation around a longitudinal axis; and vertical position fixing means disposed only at the rear heel side and the rear leg side for selectively fixing a vertical position of the longitudinal axis so that the leg overlap member rotates around the longitudinal axis relative to the heel overlap member during a time that the longitudinal axis is held in the fixed vertical position.

2. The snowboard boot according to claim 1 further comprising a pivot pin for fixing the heel overlap member to the leg overlap member for rotation around the longitudinal axis.

3. The snowboard boot according to claim 2 wherein one of the heel overlap member or leg overlap member includes a slot through which the pivot pin extends.

4. The snowboard boot according to claim 1 wherein the heel overlap member has an approximately circular cross section centered about an anklebone axis.

5. The snowboard boot according to claim 1 further comprising rotation limiting means for limiting a range of rotation of the heel overlap member relative to the leg overlap member around the longitudinal axis.

6. The snowboard boot according to claim 5 wherein the rotation limiting means allows the leg overlap member to deviate from an upright position to a greater extent in one direction than in an opposite direction.

7. The snowboard boot according to claim 1 wherein the leg overlap member and the heel overlap member interface with each other through an arcuate surface so that the leg portion inclines in a longitudinal direction with respect to the heel portion as the leg overlap member moves in the vertical direction with respect to the heel overlap member.

8. The snowboard boot according to claim 1 wherein the leg overlap portion and the heel overlap portion interface with each other through an approximately spherical surface.

9. The snowboard boot according to claim 7 wherein the arcuate surface has a constant radius of curvature.

10. The snowboard boot according to claim 1 wherein the vertical position fixing means comprises:

a pin extending through the leg overlap member and the heel overlap member;

a lever coupled to the pin;

a bearing coupled to the pin;

wherein the lever operates a cam which cooperates with a cam follower coupled to the pin so that movement of the lever causes the bearing to move toward at least one of the leg overlap member or heel overlap member for fixing the leg overlap member to the heel overlap member in the vertical position.

11. The snowboard boot according to claim 10 wherein the leg overlap member is rotatably mounted around the bearing so that the leg overlap member is capable of rotation relative to the heel overlap member when the leg overlap member is fixed to the heel overlap member in the vertical position.

12. The snowboard boot according to claim 10 wherein movement of the lever causes the bearing, the leg overlap member and the heel overlap member to be secured relative to each other for fixing the vertical position of the leg overlap member relative to the heel overlap member.

13. A snowboard boot comprising:

a toe portion;

a heel portion having an external first heel side facing laterally, an external second heel side facing medially, and a rear heel side facing to the rear of the boot;

a leg portion having an external first leg side facing laterally, an external second leg side facing medially, and a rear leg side facing to the rear of the boot;

wherein the heel portion and the leg portion are coupled at the rear heel side and the leg rear side so that the leg portion is capable of rotation around a longitudinal axis extending in a forward and rearward direction relative to the toe portion and the heel portion; and vertical position fixing means disposed only at the rear heel side and the rear leg side for selectively fixing a vertical position of the longitudinal axis so that the leg portion rotates around the longitudinal axis relative to the heel portion during a time that the longitudinal axis is held in the fixed vertical position.

* * * * *